US011026300B2

(12) United States Patent
Heffel et al.

(10) Patent No.: US 11,026,300 B2
(45) Date of Patent: Jun. 1, 2021

(54) TELESCOPIC SLIDE FOR A MICROWAVE OVEN

(71) Applicant: Accuride International GmbH, Diez (DE)

(72) Inventors: Andreas Heffel, Bendorf (DE); Philipp Krebs, Ulmen (DE)

(73) Assignee: Accuride International GmbH, Diez (DE)

( * ) Notice: Subject to any disclaimer, the term of this patent is extended or adjusted under 35 U.S.C. 154(b) by 273 days.

(21) Appl. No.: 16/159,129

(22) Filed: Oct. 12, 2018

(65) Prior Publication Data

US 2019/0150234 A1 May 16, 2019

(30) Foreign Application Priority Data

Nov. 13, 2017 (DE) ..... 10 2017 126 620.8

(51) Int. Cl.
*H05B 6/64* (2006.01)
*H05B 6/68* (2006.01)
(Continued)

(52) U.S. Cl.
CPC ..... *H05B 6/6473* (2013.01); *F24C 15/168* (2013.01); *H05B 6/6408* (2013.01); *H05B 6/6488* (2013.01)

(58) Field of Classification Search
CPC ... F24C 15/168; H05B 6/6473; H05B 6/6408; H05B 6/6488
(Continued)

(56) References Cited

U.S. PATENT DOCUMENTS 4,424,431 A * 1/1984 Gurubatham ..... H05B 6/6411 219/754
2012/0020593 A1 1/2012 Rehage et al.

FOREIGN PATENT DOCUMENTS

CN 105942901 A * 9/2016
DE 20 2009 001 962 U1 5/2010
(Continued)

OTHER PUBLICATIONS

Translation of DE102011054726A1, Method for producing a metallic component of a fitting and a metallic component for a fitting. European Patent Office , Apr. 2013. (Year: 2013).*
(Continued)

*Primary Examiner* — Quang T Van
(74) *Attorney, Agent, or Firm* — Paul & Paul

(57) ABSTRACT

A telescopic slide for a microwave oven has a first slide element and a second slide element each having two running surfaces with caged rolling bodies arranged on the running surfaces. The slide elements can be moved along against each other between a retracted position and an extended position. The slide elements each have at least one electrically conductive contact element arranged on the slide elements in such a way that in the retracted position either the contact elements are directly in engagement or that the contact element of the first slide element and the contact element of the second slide element are each in engagement with an electrically conducting conductive element that is moved concomitantly with the rolling-body cage. The result is that in the retracted position there is an electrically conducting connection between the first and the second slide elements, and in at least one position other than the retracted position the electrically conducting connection is broken.

14 Claims, 3 Drawing Sheets

(51) Int. Cl.
*H05B 6/78* (2006.01)
*F24C 15/16* (2006.01)

(58) Field of Classification Search
USPC ..... 219/681, 686, 752, 753, 754, 756, 757, 219/762; 126/21 R, 198, 200, 41 A, 338, 126/340
See application file for complete search history.

(56) References Cited

FOREIGN PATENT DOCUMENTS

| | | | |
|---|---|---|---|
| DE | 10 2011 054 726 | A1 | 4/2013 |
| DE | 102013214852 | A1 | 2/2015 |
| DE | 102013214853 | A1 | 2/2015 |
| DE | 102013214854 | A1 | 2/2015 |
| EP | 2988068 | A1 | 8/2015 |
| WO | 2013057000 | A1 | 4/2013 |

OTHER PUBLICATIONS

European Search Report, dated Apr. 9, 2019, European Patent Application No. 18203975.0 (in German).

* cited by examiner

TELESCOPIC SLIDE FOR A MICROWAVE OVEN

CROSS-REFERENCE TO RELATED APPLICATION

This application claims the priority of German Application No. 10 2017 126 620.8, filed on Nov. 13, 2017.

The present invention relates to a telescopic slide with at least one first slide element made of an electrically conductive material and a second slide element made of an electrically conductive material, wherein the first and the second slide elements each have two running surfaces, wherein rolling bodies accommodated in a rolling-body cage are arranged on the two running surfaces of the first slide element and rolling bodies accommodated in a rolling-body cage are arranged on the two running surfaces of the second slide element, and wherein the first and the second slide elements can be moved against each other between a retracted position and an extended position in an extension direction.

Telescopic slides with at least two slide elements and a rolling-body cage with rolling bodies accommodated therein, for reducing the friction between the slide elements during an extension movement, are known in various embodiments from the state of the art. They are used in various domestic appliances, but also in automobile construction and in many other applications.

While a multiplicity of fields of application can already be addressed with the known telescopic slides, hitherto telescopic slides in microwave ovens have not been able to become established. In the case of a telescopic slide with slide elements made of an electrically conductive material, in particular of a sheet metal, during operation of the microwave oven the microwave radiation that is incident on the telescopic slide results in a local charging of the slide elements and, if there is a sufficiently large potential difference between the individual slide elements, in a spark discharge between them.

In order to avoid a spark discharge, designs are known, for example from EP 2 988 068 A1, in which, through the formation of sufficiently large and electrically insulating rolling bodies, the slide elements have a sufficiently large distance from each other. However, these telescopic slides have a very large installation dimension.

There is therefore a need for a telescopic slide which avoids the above-named disadvantages, at least partly.

It is therefore proposed according to the invention to design a telescopic slide of the type named at the outset for a microwave oven such that the first slide element has at least one electrically conductive contact element and the second slide element has at least one electrically conductive contact element, wherein the contact element of the first slide element and the contact element of the second slide element are designed and are arranged on the slide elements in such a way that in the retracted position either the contact element of the first slide element and the contact element of the second slide element are in engagement with each other or the contact element of the first slide element and the contact element of the second slide element are each in engagement with an electrically conducting conductive element that is moved concomitantly with the rolling-body cage, with the result that in the retracted position there is an electrically conducting connection between the first and the second slide elements and in at least one position other than the retracted position the contact element of the first slide element and the contact element of the second slide element are not in engagement with each other or at least the contact element of the first slide element or the contact element of the second slide element is not in engagement with the conductive element, with the result that in the at least one other position the electrically conducting connection is broken.

It is decisive for the present invention to recognize that the mechanical engagement and thus the direct electrically conducting connection between the contact elements are necessary only in the slid-in state. Microwave ovens can as a rule only be put into operation, i.e. the electromagnetic microwave radiation can only act on the telescopic slide, when the door of the microwave oven is closed. However, closing of the door presupposes that the slide elements of the telescopic slide no longer protrude beyond the muffle of the microwave oven.

By the retracted position, within the meaning of the present application, is meant the position of the first and second slide elements relative to each other in which the telescopic slide is fully slid in. Typically, the retracted position is characterized by the reaching of an end stop.

At least in one position other than the retracted position the contact elements according to the invention do not provide an electrically conducting connection, i.e. the electrically conducting connection is then broken.

By an engagement between the contact element of the first slide element and the contact element of the second slide element, within the meaning of the present application, is meant a direct mechanical contact of their surfaces which is created in such a way that an electric current can flow between the contact elements and across the engagement point, i.e. across the point of physical contact between the two contact elements.

It has surprisingly been shown that the contact elements according to the invention in the retracted position can effectively prevent not only a sparking between edges and tips of adjacent slide elements but also a punctiform current flow across the rolling bodies of the telescopic slide. This proves to be advantageous in particular because punctiform currents flowing across the points of physical contact of the rolling bodies with the running surfaces of the slide elements can result in damage to the rolling bodies and the running surfaces, and in addition lubricant in the area around the rolling bodies can be destroyed by thermal influence.

To realize the advantages of the present invention, it is necessary to effect a potential equalization of at least one slide element which is exposed to the microwave radiation. Firstly, it is unimportant here whether the local charges produced there discharge to a directly adjacent slide element or to another slide element. In the case of a full extension slide with three slide elements, the charges can alternatively discharge to the middle slide element or to the inner slide element.

When a telescopic slide is mentioned within the meaning of the present application, this term is understood to mean, in general, that it comprises not only slides in which the first slide element and the second slide element have approximately the same length but also linear guides in which the first slide element is much shorter than the second slide element.

If it is stated in the present application that the telescopic slide according to the invention has a first slide element and a second slide element, this does not rule out the telescopic slide comprising further slide elements, in particular for providing a full extension slide.

By a rolling body, within the meaning of the present application, is meant a rotational body which, as an element of a guide, substantially reduces the friction between the various slide elements and thereby facilitates a relative movement of two slides in relation to each other. Rolling bodies are, for example, balls, rollers, barrels, needles or cones.

In an embodiment of the present invention, the rolling bodies are balls. It is understood that in this case the rolling-body cage is a ball cage.

In an embodiment of the invention, the first slide element and the second slide element are produced from a material selected from a group consisting of sheet steel, aluminium-coated sheet steel and stainless steel.

In particular, in an embodiment of the invention, the rolling bodies can be manufactured from an electrically conductive material, for example from steel.

In an embodiment of the invention, at least the first slide element or the second slide element has two limbs which form the running surfaces for the rolling bodies and a connection portion connecting the two limbs, wherein the contact element is arranged on the connection portion.

It is understood that the contact elements are connected in an electrically conducting manner to the slide elements, in order to be able to provide the potential equalization. In an embodiment, at least one of the contact elements is formed as one piece with the respective slide element.

In an embodiment, at least one of the contact elements is formed by a protrusion on the first or second slide element. It is expedient here if the protrusion has a greater extent in the extension direction than in a direction perpendicular to the extension direction. A greater extent of the protrusion in the extension direction than in a direction perpendicular to the extension direction ensures the functioning of the contact elements even when the telescopic slide is not fully run in, i.e. in the retracted position.

This is advantageous in particular when, in an embodiment of the invention, the length of the telescopic slide in the extension direction is dimensioned such that, even after closure of a door of a domestic appliance in which the telescopic slide is fitted, the telescopic slide is not fixed in exactly one position, but the two slide elements can be arranged relative to each other in a range of positions. It is then necessary to ensure the electrical contact between the two slide elements over this range.

In particular in the case of a full extension slide, a protrusion elongated in such a manner in the extension direction can also be arranged on a middle slide element, which in the region of its connection portion permits only a small structural size of the protrusion.

In an embodiment of the invention, the protrusion is formed as a stamping of a sheet material of the respective slide element. Such beads can be easily produced in a cost-effective manner.

In a further embodiment of the invention, the contact element of the first slide element is formed by a protrusion and the contact element of the second slide element is formed by a protrusion, wherein the protrusion on the first slide element has a greater extent in the extension direction than in a direction perpendicular to the extension direction, and wherein the protrusion on the second slide element has a smaller extent in the extension direction than in the direction perpendicular to the extension direction.

Elongated protrusions, as contact elements, arranged crosswise in relation to each other in such a way on the two slide elements are able to compensate the tolerances of the profiles of the slide elements and of the assembly. In an embodiment, the tolerance chain to be taken into account here also includes the dimensions of the constructed space of a domestic appliance, in particular the muffle of a microwave oven, as well as the door that closes it.

In an embodiment of the invention, the telescopic slide provides a full extension slide, wherein the telescopic slide has two outer slide elements and a middle slide element, and wherein the protrusion with the extent that is greater in the extension direction than the extent in the direction perpendicular to the extension direction is provided on the middle slide element.

In an embodiment of the invention, the contact elements are in engagement with each other or are both in engagement with the conductive element exclusively in the retracted position, i.e. when the end stop is reached.

In a further embodiment, the contact elements are in engagement with each other or are both in engagement with the conductive element in the retracted position and over a partially extended region in the area around the retracted position, wherein the length of the region in the extension direction over which the contact elements are in engagement with each other in the partially extended state is predetermined by an extent and/or a position of the contact elements on the slide elements in the extension direction.

In this way it is ensured that a potential equalization between the slide elements is effected even when the telescopic slide is in an almost, but not fully slid-in state.

Irrespective of the necessity that the two slide elements have to be connected to each other in an electrically conducting manner when the telescopic slide is in the fully slid-in state or almost fully slid-in state, it has been shown that the location of the electrical contact between the contact elements of the first slide element and the second slide element, as viewed in the extension direction of the telescopic slide, can also be selected such that it is associated with advantages.

It has been shown that sparkovers between the slide elements typically occur at their ends, since here, on the one hand, there are edges and a tip, but on the other hand the slide elements can also come comparatively close to each other spatially at the ends.

In an embodiment of the invention, therefore, the contact element of the first slide element and the contact element of the second slide element are arranged and designed in such a way that in the retracted position the location of the engagement between the contact element of the first slide element and the contact element of the second slide element or the location of the engagement between the contact element of a slide element and the conductive element is at a distance of 50 mm or less, measured in the extension direction, preferably at a distance of 40 mm or less, and particularly preferably at a distance of 30 mm or less from an end of a slide element.

In an embodiment, moreover, in the retracted position the location of the engagement between the contact element of the first slide element and the contact element of the second slide element or the location of the engagement between the contact element of a slide element and the conductive element is at a distance of 5 mm or more, measured in the extension direction, from the end of a slide element.

Surprisingly, it is not only the choice of the position of the electrical contact between the contact elements in the retracted position in the region of the ends of the slide elements that results in advantages, but also an arrangement of the electrical contact in the region in which the ball cage is located in the retracted position. An engagement between the contact elements at a position in a region in which the ball cage is located in the retracted position results in currents across the balls being reduced to such an extent that no damage is caused to the elements of the telescopic slide.

In an embodiment of the invention, therefore, the contact element of the first slide element and the contact element of the second slide element are arranged and designed in such a way that in the retracted position the location of the engagement between the contact element of the first slide element and the contact element of the second slide element or the location of the engagement between a contact element and the conductive element in the extension direction lies in a region in which the ball cage is located.

It can be sufficient if, in an embodiment of the invention, the first slide element and the second slide element each have a contact element, which contact elements are in engagement with each other in the retracted position. In this case, an electrically conducting connection between the first slide element and the second slide element is provided at precisely one position in the extension direction of the telescopic slide, when the telescopic slide is slid in.

It is likewise conceivable, however, that a plurality of contact elements is provided after the first slide element and a plurality of contact elements is provided at the second slide element, which are in electrically conducting engagement with each other in the retracted position. A potential equalization is then effected at a plurality of positions in the extension direction of the telescopic slide.

In an embodiment of the invention, the first slide element has three contact elements and the second slide element has three contact elements, which are in engagement with each other in the retracted position, wherein two of the contact elements of each slide element are provided at the ends of the respective slide element and in each case one contact element is provided in the centre of each slide element. In this way, sparking at the ends of the slide elements can be avoided and a flow of current across the rolling bodies in the centre of the slide elements can be reduced.

In an embodiment of the invention, the telescopic slide is a full extension slide with two outer slide elements and a middle slide element arranged between the two outer slide elements, wherein the two outer slide elements each have at least one contact element and the middle slide element has at least two contact elements, with the result that in the retracted position either a contact element of the outer slide element is in engagement with a contact element of the middle slide element or a contact element of an outer slide element and a contact element of the middle slide element are each in engagement with an electrically conducting conductive element that is moved concomitantly with the rolling-body cage, with the result that in the retracted position there is an electrically conducting connection between both outer slide elements and the middle slide element.

In a further embodiment, at least the first or the second slide element has, at an end thereof, an electrical insulation, which is designed in such a way that in the retracted position the insulation is arranged in a possible spark gap between the first and the second slide element. By arranging an electrical insulator, i.e. a dielectric, between the slide elements, or between portions of the slide elements, the dielectric strength is increased and the probability of a spark discharge is considerably reduced. Such an embodiment makes sense in particular when the contact elements are provided exclusively in a region in which the rolling-body cage is arranged in the retracted position.

Besides embodiments of the present invention in which the contact elements of the first and second slide element are directly in engagement with each other in an electrically conducting manner in the retracted position, the solution according to the invention also includes embodiments in which each of the contact elements of the first or second slide element are in engagement with an electrically conducting conductive element that is moved concomitantly with the rolling-body cage, but are not in direct engagement with each other. Such an embodiment has the advantage that the material of the conductive element can be designed to be thinner, and therefore more flexible, than the material of the slide elements themselves. This optimizes the electrical contact between the contact elements of the slide elements and the conductive element, and therefore between the first and the second slide elements.

Here, in an embodiment of the invention, the conductive element is formed by the rolling-body cage itself.

One of the previously named objects is also achieved by a microwave oven with a telescopic slide in an embodiment thereof as previously described.

In an embodiment of the invention, the lengths of the slide elements of the telescopic slide are selected such that the latter is in the retracted position, or else in an only partially extended position, when the door of the microwave oven is closed. In this way, closing of the door of the microwave oven also ensures an electrically conducting contact between the contact elements, and therefore a potential equalization between the slide elements.

In an embodiment of the invention, therefore, the microwave oven has an oven muffle and a door for closing the oven muffle, wherein the door can be moved between a position that closes the oven muffle and a position that releases the oven muffle. The telescopic slide here is built into the oven muffle in such a way that, when the door is in the position that releases the oven muffle, the first slide element or the second slide element can be brought into the extended position, with the result that the first slide element or the second slide element protrudes out of the oven muffle. Furthermore, at least one length of the first slide element or one length of the second slide element in the extension direction is selected in such a way and the contact element of the first slide element and the contact element of the second slide element are arranged and designed in such a way that, when the door is in the position that closes the oven muffle, inevitably the contact element of the first slide element and the contact element of the second slide element are in engagement with each other or the contact element of the first slide element and the contact element of the second slide element are each in engagement with the electrically conducting conductive element that is moved concomitantly with the rolling-body cage, with the result that there is an electrically conducting connection between the first and the second slide elements.

In an embodiment of the invention, the door or the telescopic slide of the microwave oven has an elastic part which, when the door is in the position that closes the oven muffle, is arranged between the door and an end of the first and/or second slide element.

In an embodiment of the invention, the elastic part is fastened to an end of the first slide element or of the second slide element. Alternatively or additionally, an elastic part can be fastened to the door of the oven itself.

In an embodiment of the invention, the elastic part is a shaped elastic part produced from silicone.

In a further embodiment, the elastic part is dimensioned in such a way that, when the door is in the position that closes the oven muffle, it is in engagement with the door and the telescopic slide. In particular, in an embodiment, the part is then elastically deformed. Further advantages, features and possible applications of the present invention will become apparent from the following description of an embodiment and the associated figures.

In the figures, elements that are the same are given the same reference numbers.

Figure 1:
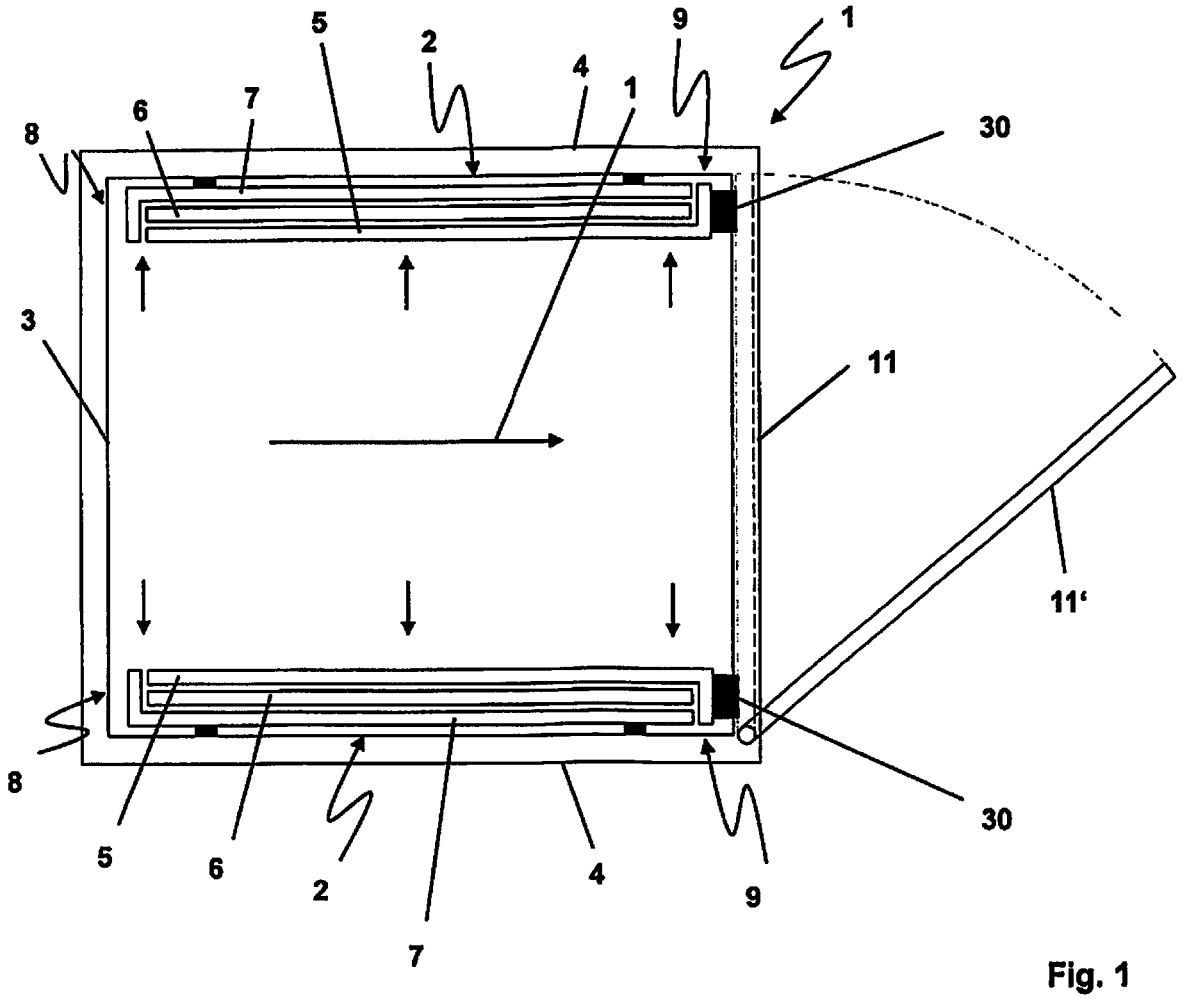
FIG. 1 is a schematic top view of a microwave oven according to an embodiment of the present invention.

FIG. 1 shows a microwave oven 1 with two telescopic slides 2 according to the invention, which are each connected to a side wall 3 of the muffle 4 of the oven 1. The telescopic slides 2 are full extension slides with three slide elements 5, 6, 7.

During operation of the microwave oven 1 the telescopic slides 2, but in particular the inner slide elements 5, are exposed to the microwave radiation of the oven. This electromagnetic radiation results in a local electrostatic charge in the slide elements 5. This charge can, in turn, result in sparkovers in the region of the ends 8, 9 of the slide elements 5, 6, 7.

In addition, arranged between the slide elements 5, 6, 7 of the telescopic slides 2 are ball cages with ball bearings (not shown in FIG. 1) arranged therein, which serve to guide the individual slide elements 5, 6, 7 relative to each other. The electrostatic charge of the slide elements 5, 6, 7 can also result in currents discharging across the ball bearings. Owing to the punctiform physical contact of the ball bearings with the running surfaces of the slide elements 5, 6, 7, high currents can be produced, which result in damage, either to the balls or to the running surfaces.

In order to prevent the local electrostatic charge, in particular of the slide element 5, the telescopic slides 2 each provide an electrically conducting connection at the three positions identified by arrows along the extension direction 10 of the telescopic slide 2.

When the door 11' is in an open position, the slide elements 5, 6 can be drawn out through the opening of the muffle 4.

However, the microwave oven 1 can only be put into operation when the door 11 is closed. In other words, an electrostatic charging of the slide elements 5 can only ever occur when the door 11 is closed. It therefore suffices if the potential equalization is only possible in the represented retracted position of the telescopic slides 2.

In the embodiment shown in FIG. 1, therefore, the lengths of the slide elements 5, 6, 7 in the extension direction 10 are dimensioned such that, when the door 11 is closed, the slide elements are substantially in the retracted position. Furthermore, the contact elements of the first slide element 5 and the contact elements of the second slide element 6 are arranged and designed in such a way that, when the door 11 is in the closed state, the contact elements of the first slide element 5 and the contact elements of the second slide element 6 are inevitably in engagement with each other, with the result that there is an electrically conducting connection between the first and the second slide elements 5, 6.

In order to be able to compensate the comparatively long tolerance chain, consisting of the tolerances of the door 11, 11' and its fastening, the muffle 4 and the telescopic slides and their assembly, a shaped silicone part 30 is arranged at the end 9 of the first, inner slide element 5 facing towards the opening of the muffle 4. When the door 11 is in the closed state, this shaped silicone part extends between the door 11 and the end 9 of the inner slide element 5. The shaped silicone part 30 here is dimensioned such that it is in engagement with the door 11 and if necessary is elastically deformed by the latter.

Figure 2:
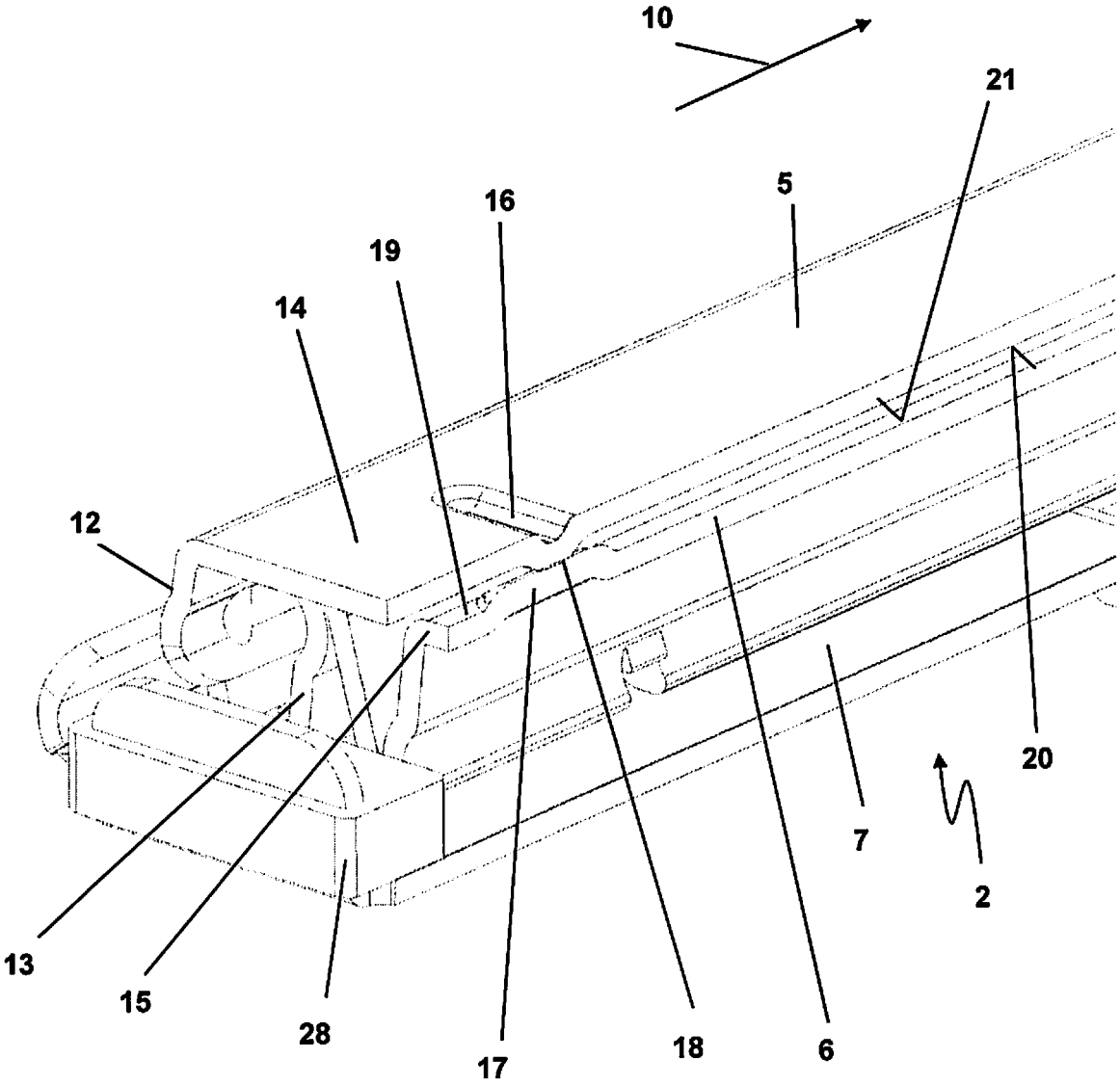
FIG. 2 is a perspective, broken-open view of an embodiment of the telescopic slide according to the invention.
Figure 3:
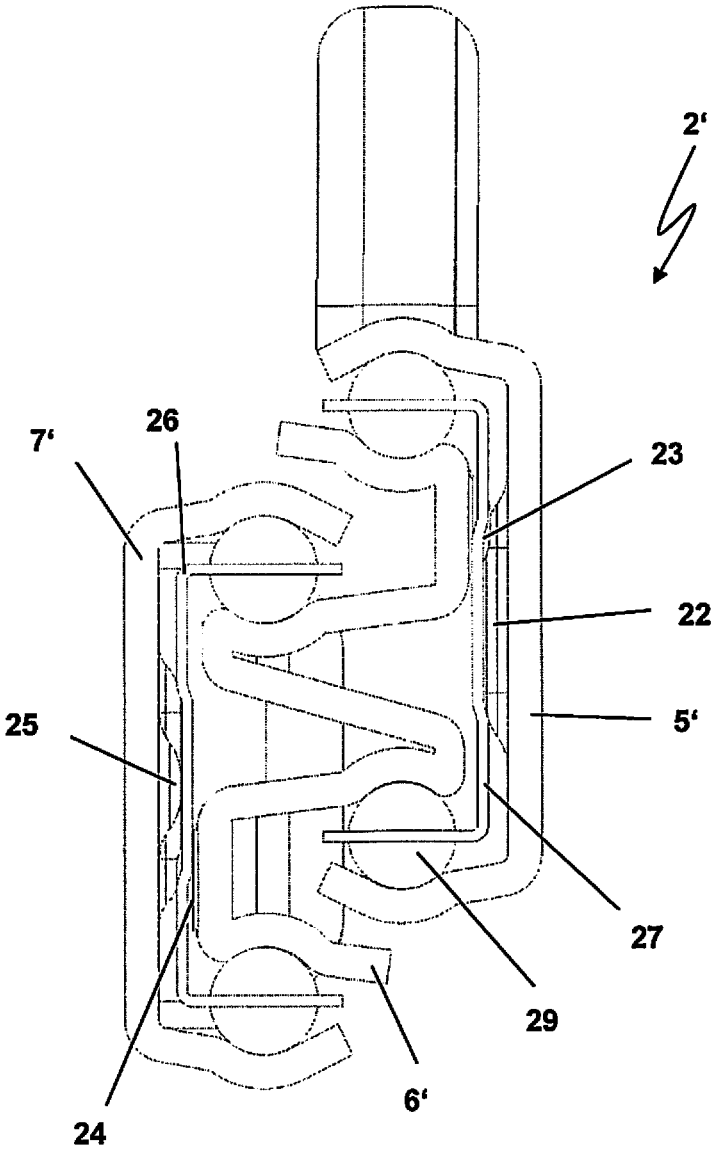
FIG. 3 is a schematic cross-sectional view of an alternative embodiment of the telescopic slide according to the invention.

FIG. 2 shows a broken-open, perspective view of the telescopic slide 2 from FIG. 1. It can be clearly seen that the telescopic slide 2 has two outer slide elements 5, 7 and a middle slide element 6, which together form a full extension slide. In the retracted position, which is also represented in FIG. 2, the outer slide element 5 and the middle slide element 6 are connected to each other in an electrically conducting manner. Here, within the meaning of the present application, the outer slide element 5 forms a first slide element and the middle slide element 6 forms a second slide element.

Each of the first and second slide elements 5, 6 has in each case two limbs 12, 13, wherein only one of the limbs 12, 13 of each slide element 5, 6 is shown in the representation from FIG. 2. The limbs 12, 13 here form the raceways for accommodating the ball bearings between the slide elements 5, 6, 7. The two limbs 12, 13 of a slide element are in turn connected to each other via connection portions 14, 15 of the slide elements 5, 6.

In order now to provide the necessary potential equalization in the retracted position, the connection portions 14, 15 of both slide elements 5, 6 are provided with indentations or beads 16, 17. On the respectively other side of the sheet material of the slide elements 5, 6 these beads 16, 17 form protrusions 18, 19, which protrude relative to the surfaces 20, 21 of the connection portions 14, 15 of the slide elements 5, 6. These protrusions 18, 19 on the connection portions 14, 15 of the slide elements 5, 6 form contact elements within the meaning of the present application.

The protrusions 18, 19 here are designed such that they are in mechanical engagement with each other only in the retracted position. If the slide elements 5, 6, 7 are extended, the protrusions 17, 18 are not in engagement. Only the mechanical engagement, however, provides an electrically conductive connection between the first slide element 5 and the second slide element 6.

In the embodiment shown, the bead 16, and therefore the protrusion 18, on the first slide element 5 has an extent in the extension direction 10 of the telescopic slide 2 which is smaller than the extent of the bead 16, and therefore of the protrusion 18, in the direction perpendicular to the extension direction 10. In contrast, the bead 17, and therefore the protrusion 19, on the second slide element 6 has an extent in the extension direction 10 which is greater than the extent of this protrusion in the direction perpendicular to the extension direction 10.

This crossed arrangement of the protrusions 17, 18 makes a certain compensation of the tolerances of the slide elements and of the assembly of the slide elements 5, 6, 7 possible. In particular, however, the extensive longitudinal extent in the extension direction 10 of the protrusions 19 makes an engagement possible between the protrusions 18, 19 over a region. The conductive connection between the protrusions 18, 19, as contact elements, is thus provided not only in the retracted position defined by the end stop but also in a region close to the retracted position.

In addition, arranged at the end of the inner slide element 7 is an electrical insulator 28 which in the retracted position is located between the middle slide element 6 and the inner slide element 7. The insulator 28 thus lies in a possible spark gap between the middle slide element 6 and the inner slide element 7 and prevents a sparking between the slide elements 6, 7.

In the embodiment of the telescopic slide 2 from FIG. 2, the electrically conductive connection between the first and the second slide elements 5, 6 is provided by a direct mechanical engagement between the two protrusions 18, 19 of the slide elements 5, 6. In contrast, the electrical connection of each two slide elements 5', 6' and 6', 7' is provided via the ball cages 26, 27 arranged between the contact elements 22, 23 and 24, 25 respectively.

In this embodiment of a telescopic slide 2' according to the invention, in the retracted position the contact elements 22, 23 are in engagement with the first ball cage 27 as a conductive element within the meaning of the present application. In the retracted position the contact elements 24, 25 are in engagement with the second ball cage 26.

It is to be noted here that, in the embodiment represented, the engagement between the contact element 23 on the second slide element 6' and the ball cage 27, on the one hand, and the engagement between the contact element 22 on the first slide element 5' and the ball cage 27, on the other hand, is effected at different positions in a direction perpendicular to the extension direction 10. In this way, the spring property of the ball cage 27 can be utilized in order to ensure an improved electrical contact between the contact elements 22, 23 and the ball cage 27.

For purposes of original disclosure, it is pointed out that all features, as revealed to a person skilled in the art from the present description, the drawings and the claims, even if they have specifically been described only in connection with particular further features, can be combined, both individually and in any combinations, with others of the features or feature groups disclosed here, unless this has been explicitly ruled out or unless technical circumstances make such combinations impossible or meaningless. Only, for reasons of the brevity and readability of the description, a comprehensive, explicit presentation of all conceivable feature combinations is dispensed with here.

While the invention has been represented and described in detail in the drawings and the preceding description, this representation and description are merely exemplary and are not intended as a limitation of the scope of protection as defined by the claims. The invention is not limited to the disclosed embodiments.

For a person skilled in the art, modifications of the disclosed embodiments are obvious from the drawings, the description and the attached claims. In the claims the word "have" does not rule out other elements or steps, and the indefinite article "a" or "an" does not rule out a plurality. The mere fact that certain features are claimed in different claims does not rule out their combination. Reference numbers in the claims are not intended as a limitation of the scope of protection.

LIST OF REFERENCE NUMBERS

1 microwave oven
2, 2' telescopic slide
3 side wall
4 muffle
5, 5', 6, 6', 7, 7' slide element
8, 9 ends of the slide elements 5, 6, 7
10 extension direction
11, 11' door
12, 13 limb
14, 15 connection portion
16, 17 bead
18, 19 protrusion
20, 21 surface
22, 23, 24, 25 contact element
26, 27 ball cage
28 insulator
29 ball bearing
30 shaped silicone part

The invention claimed is:

1. Telescopic slide (2, 2') for a microwave oven (1) with at least one first slide element (5, 5') made of an electrically conductive material and a second slide element (6, 6') made of an electrically conductive material, wherein the first and the second slide elements (5, 5', 6, 6') each have two running surfaces, wherein rolling bodies (29) accommodated in a rolling-body cage (26, 27) are arranged on the two running surfaces of the first slide element (5, 5') and rolling bodies (29) accommodated in a rolling-body cage (26, 27) are arranged on the two running surfaces of the second slide element (6, 6'), and wherein the first and the second slide elements (5, 5', 6, 6') can be moved against each other between a retracted position and an extended position in an extension direction (10), characterized in that the first slide element (5, 5') has at least one electrically conductive contact element (18, 22) and the second slide element (6, 6') has at least one electrically conductive contact element (19, 23), wherein the contact element (18, 22) of the first slide element (5, 5') and the contact element (19, 23) of the second slide element (6, 6') are designed and arranged on the slide elements (5, 5', 6, 6') in such a way that in the retracted position either the contact element (18) of the first slide element (5) and the contact element (19) of the second slide element (6) are in engagement with each other or the contact element (22) of the first slide element (5') and the contact element (23) of the second slide element (6') are each in engagement with an electrically conducting conductive element that is moved concomitantly with the rolling-body cage (26), with the result that in the retracted position there is an electrically conducting connection between the first and the second slide elements (5, 5', 6, 6') and in at least one position other than the retracted position the contact element (18) of the first slide element (5) and the contact element (19) of the second slide element (6) are not in engagement with each other or at least the contact element (22) of the first slide element (5') or the contact element (23) of the second slide element (6') is not in engagement with the conductive element, with the result that in the at least one other position the electrically conducting connection is broken, wherein at least the first slide element (5, 5') or the second slide element (6, 6') has two limbs (12, 13), which limbs form the running surfaces of the rolling bodies (29), and wherein the first slide element (5, 5') and the second slide element (6, 6') each have a connecting portion (14, 15) connecting the two limbs (12, 13), wherein the contact elements (18, 19) of the first slide element (5, 5') and the contact elements (22, 23) of the second slide element (6, 6') are each arranged on the connecting portions (14, 15).

2. Telescopic slide (2, 2') according to claim 1, characterized in that at least one of the contact elements (18, 19, 22, 23, 24, 25) is formed by a protrusion on the first or second slide element (5, 5', 6, 6').

3. Telescopic slide (2, 2') according to claim 2, characterized in that at least one protrusion (18) has a greater extent in the extension direction (10) than in a direction perpendicular to the extension direction (10).

4. Telescopic slide (2, 2') according to claim 2, characterized in that the protrusion is formed as a stamping (16, 17) of a sheet material of the respective slide element (5, 6).

5. Telescopic slide (2, 2') according to claim 1, characterized in that the contact element of the first slide element (5) is formed by a protrusion (18) and the contact element of the second slide element (6) is formed by a protrusion (19), wherein the protrusion (18) on the first slide element (5) has a greater extent in the extension direction (10) than in a direction perpendicular to the extension direction (10), and wherein the protrusion (19) on the second slide element (6) has a smaller extent in the extension direction (10) than in the direction perpendicular to the extension direction (10).

6. Telescopic slide (2, 2') according to claim 5, characterized in that it has two outer slide elements (5, 7) and a middle slide element (6), wherein the protrusion (19) with the extent that is greater in the extension direction (10) than the extent in the direction perpendicular to the extension direction (10) is provided on the middle slide element (6).

7. Telescopic slide (2, 2') according to claim 1, characterized in that the contact elements (18, 19, 22, 23, 24, 25) are in engagement with each other or are both in engagement with the conductive element exclusively in the retracted position.

8. Telescopic slide (2, 2') according to claim 1, characterized in that the contact elements (18, 19) are in engagement with each other or are both in engagement with the conductive element in the retracted position and in the extended position (10), starting from the retracted position, over a range of positions outside the retracted position, wherein the length of the region in the extension direction (10) is predetermined by an extent and/or a position of the contact elements (18, 19) on the slide elements (5, 6) in the extension direction (10).

9. Telescopic slide (2, 2') according to claim 1, characterized in that the contact element (18) of the first slide element (5) and the contact element (19) of the second slide element (6) are arranged and designed in such a way that in the retracted position the position of the engagement between the contact element (18) of the first slide element (5) and the contact element (19) of the second slide element (6) in the extension direction (10) lies in a region in which the ball cage is located.

10. Telescopic slide (2, 2') according to claim 1, characterized in that the telescopic slide (2, 2') has two outer slide elements (5, 7) and a middle slide element (6) arranged between the two outer slide elements (5, 7), wherein the two outer slide elements (5, 7) each have at least one contact element (18) and the middle slide element (6) has at least two contact elements (19), with the result that in the retracted position either a contact element (18) of each outer slide element (5, 7) is in each case in engagement with a contact element (19) of the middle slide element (6) or a contact element of an outer slide element and a contact element of the middle slide element are in each case in engagement with an electrically conducting conductive element that is moved concomitantly with a rolling-body cage, with the result that in the retracted position there is an electrically conducting connection between the outer slide elements and the middle slide element.

11. Telescopic slide (2, 2') according to claim 1, characterized in that at least the first or the second slide element (5, 6), at an end (8, 9) thereof, has an insulation (28), which is designed in such a way that in the retracted position it is arranged in a possible spark gap between the first and the second slide element (5, 6).

12. Telescopic slide (2, 2') according to claim 1, characterized in that the conductive element is a portion of the rolling-body cage.

13. Microwave oven (1) with a telescopic slide (2, 2') according to claim 1.

14. Microwave oven (1) according to claim 13, characterized in that the microwave oven (1) has an oven muffle (4) and a door (11, 11') for closing the oven muffle (4), wherein the telescopic slide (2, 2') is built into the oven muffle (4) in such a way that, when the door (11, 11') is in a position that releases the oven muffle (4), the first slide element (5, 5') or the second slide element (6, 6') can be brought into the extended position, with the result that the first slide element (5, 5') or the second slide element (6, 6') protrudes out of the oven muffle (4), and wherein at least one length of the first slide element (5, 5') or one length of the second slide element (6, 6') in the extension direction (10) is selected in such a way and the contact element (18) of the first slide element (5) and the contact element (19) of the second slide element (6) are arranged and designed in such a way that, when the door (11, 11') is in a position that closes the oven muffle (4), inevitably the contact element (18) of the first slide element (5) and the contact element (19) of the second slide element (6) are in engagement with each other or the contact element (22) of the first slide element (5') and the contact element (23) of the second slide element (6') are each in engagement with the electrically conducting conductive element that is moved concomitantly with the rolling-body cage (26), with the result that there is an electrically conducting connection between the first and the second slide elements (5, 5', 6, 6').

* * * * *